US005125878A

United States Patent [19]

Wingate et al.

[11] Patent Number: 5,125,878

[45] Date of Patent: Jun. 30, 1992

[54] HAND EXERCISING APPARATUS

[75] Inventors: Barry Wingate; Patrick R. Grey, both of Santa Clara County, Calif.

[73] Assignee: Meddev Corporation, Los Altos, Calif.

[21] Appl. No.: 575,061

[22] Filed: Aug. 30, 1990

[51] Int. Cl.[5] ..... A63B 23/14

[52] U.S. Cl. ..... 482/49; 482/121; 482/139

[58] Field of Search ..... 272/67, 68, 143, 135, 272/137; 128/26, 24 R

[56] References Cited

U.S. PATENT DOCUMENTS

| | | | |
|---|---|---|---|
| 2,621,652 | 12/1951 | Ehrhardt | 272/57 |
| 3,570,849 | 3/1969 | Ratchford | 272/68 |
| 4,226,412 | 10/1980 | Panepinto | 272/142 X |
| 4,553,746 | 11/1985 | Lee | 272/68 |

*Primary Examiner*—Richard J. Apley
*Assistant Examiner*—D. F. Crosby
*Attorney, Agent, or Firm*—Flehr, Hohbach, Test, Albritton & Herbert

[57] ABSTRACT

A hand exercising apparatus for strengthening the hand and forearm muscles and improving joint mobility while protecting the skin of a hand using the apparatus is disclosed. The apparatus includes an outer frame having an outer crossbar and an outer grip bar transversely mounted between two parallel rods. An inner frame is slidably mounted in the outer frame and has an inner crossbar and an inner grip bar parallel and adjacent to the outer crossbar and the outer grip bar. A coupling assembly connects the outer crossbar to the inner crossbar and provides a resisting force as the inner frame is moved along the outer frame. An altering device increases and decreases the distance over which the inner frame may be moved along the outer frame. An inner cushion sleeve is mounted on the inner grip bar, while an outer cushion sleeve having an area of reduced thickness for receiving the second crossbar is mounted on the outer grip bar. A ridge protruding from the inner surface of the outer cushion sleeve fits into a channel formed in the outer grip bar.

33 Claims, 2 Drawing Sheets

HAND EXERCISING APPARATUS

BRIEF DESCRIPTION OF THE INVENTION

This invention relates in general to an apparatus for exercising the muscles in the hand and forearm, and more particularly to an apparatus through which the muscles in the hand and forearm are strengthened by a series of repeated grasping and releasing movements.

BACKGROUND OF THE INVENTION

An individual may wish to strengthen the muscles in the hand and forearm, and impose mobility of joints in the hand to improve work and athletic performance, or to regain the strength and dexterity lost because of injury or illness. The muscles may be strengthened by using an exercising apparatus having two components which provide a resisting force as a hand grasps the components and compresses them together. Through sessions involving a series of repeated grasping and releasing motions, the muscles are strengthened.

As the physical condition of the hand and forearm improves, a greater resisting force is required for continued progress. During the rehabilitative treatment of a patient, the careful monitoring and adjustment of the resisting force provided by the apparatus is essential. The patient begins treatment with impaired hand strength and dexterity. The resisting force must be gradually increased as the patient regains muscle strength. A hand and finger exerciser, disclosed in U.S. Pat. No. 3,570.849 to Ratchford, describes an apparatus which has means for adjusting the tension and which allows natural movement of the hand.

Adjusting the tension in the apparatus provides one way of controlling the motion of the hand as it compresses the two components together. Alternatively, the initial distance separating the components could be adjusted to control the hand stroke. The initial separation would be increased to permit a fuller range of hand motion as dexterity is regained. The apparatus could be adapted for use in strengthening the muscles in smaller hands by decreasing the initial distance between the components. Thus, providing a way in which the initial separation between the components could be varied would increase the versatility and effectiveness of the apparatus.

To achieve any significant improvement in the condition of the muscles, the hand must repeatedly grasp and release the components of the apparatus. After even a short period of use, the portions of the hand in contact with the components become sore. During the grasping-releasing motion, the components may abrade or pinch the skin, which can lead to the development of blisters. These discomforts will often induce the user to shorten or postpone the exercise sessions. While this may pose as a minor setback to someone using the apparatus for personal improvement, the consequences to a patient using the apparatus as part of physical therapy are more serious.

A patient who shortens the exercise sessions to avoid the discomfort caused by using the apparatus slows the rehabilitative process and must therefore spend more time in physical therapy. The patient will also contort the grasping stroke in an attempt to reduce the pain. An improper grasping stroke may cause the apparatus to work different muscles, further impairing the patient's rehabilitation. The discomfort caused by the repeated grasping of the components tends to reduce the efficiency of the apparatus. Thus, providing some degree of protection for the user's hand would improve the effectiveness of the exercising apparatus.

OBJECTS AND SUMMARY OF THE INVENTION

Accordingly, it is a primary object of this invention to provide a hand exercising apparatus which protects the hand from the pain and discomfort caused by repeated use.

A further object of the invention is to provide a hand exercising apparatus which is adaptable to control the motion of the hand.

Another object of the invention is to provide a hand exercising apparatus which is adaptable for use by a variety of hand sizes.

Another object hereof is to provide a hand exercising apparatus which enables the user to gradually strengthen the muscles in the hand and forearm.

Yet another object of the invention is to provide a hand exercising apparatus which improves the dexterity of the hand.

A more general object of the invention is to provide a hand exercising apparatus which is inexpensive to manufacture, compact, easy to use, and facilitates muscle improvement.

Another general objective is to provide a hand exercising apparatus that can be held in different ways to exercise different elements of hand function.

In summary, this invention provides a hand exercising apparatus for strengthening the hand and forearm muscles while reducing the discomfort and soreness which often develops during use. The hand exercising apparatus includes an inner frame slidably mounted in an outer frame. A coupling means connects the inner frame to the outer frame and provides a resisting force as the inner frame is moved. The distance over which the inner frame may be moved along the outer frame is altered by spring clips which are mounted on the outer frame.

The outer frame consists of an outer crossbar and an outer grip bar transversely mounted between a pair of parallel rods. The inner frame includes an inner crossbar and an inner grip bar which are parallel and adjacent to the outer crossbar and the outer grip bar of the outer frame. The coupling means connects the outer crossbar of the outer frame to the inner crossbar the inner frame.

In order to protect the hand from soreness and discomfort, an inner cushion sleeve is mounted on the inner grip bar and an outer cushion sleeve is mounted on the outer grip bar. The second cushioning sleeve has a reduced area of thickness formed for receiving the inner grip bar as the inner frame is moved along the outer frame. To prevent rotation about the outer grip bar, a ridge protrudes from the inner surface of the outer cushion sleeve and fits into a channel formed in the outer grip bar.

DETAILED DESCRIPTION OF THE INVENTION

Figure 1:
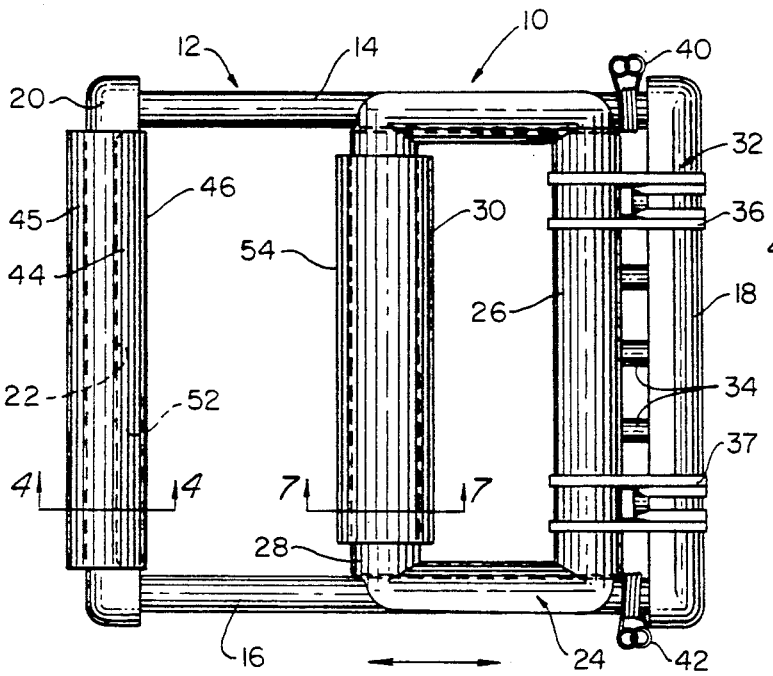
FIG. 1 shows a frontal view of a hand exercising apparatus designed in accordance with this invention, with an inner frame in an initial position within an outer frame.

Reference will now be made in detail to the preferred embodiment of the invention, which is illustrated in the accompanying figures. Turning now to the drawings, wherein like components are designated by like reference numerals throughout the various figures, attention is first directed to FIGS. 1-3.

Figure 2:
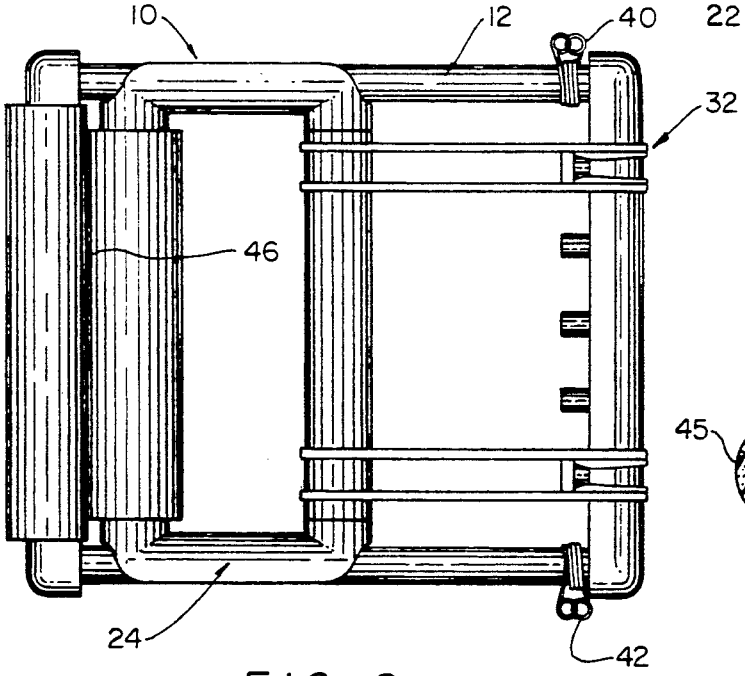
FIG. 2 shows a frontal view of the hand exercising apparatus of FIG. 1, where the inner frame has been moved along the outer frame.
Figure 3:
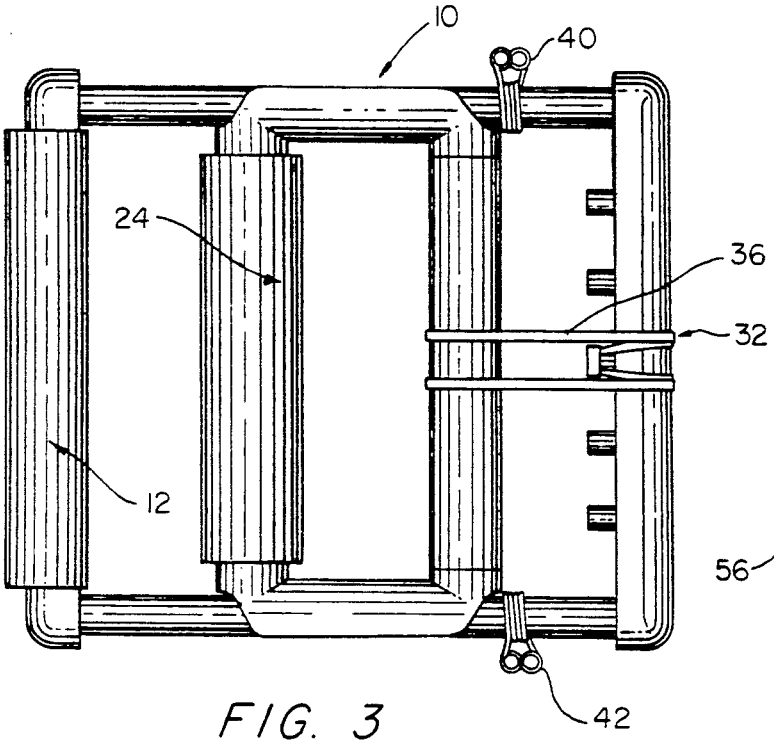
FIG. 3 shows a frontal view of the hand exercising apparatus of FIG. 1, where the distance over which the inner frame may move along the outer frame has been reduced.

A hand exercising apparatus 10 incorporating this invention is generally shown in FIGS. 1-3. An inner frame 24 is slidably mounted in an outer frame 12. A coupling means 32 connects the inner frame to the outer frame. The coupling means comprises elastic bands or other elastomers which stretch and provide a resisting force when inner frame 24 is moved along outer frame 12 in the general direction designated by the arrow. Spring clips 40 and 42, which may be positioned at different locations along outer frame 12 provide the means for altering the distance along the outer frame over which inner frame 24 may be moved. As shown in FIG. 3, by adjusting the location of the spring clips, the stroke distance of the inner frame is decreased.

The spring clips comprise a helical coil with extension forming loops at both ends of the coil. The natural state of the coil's diameter is less than the diameter of guide rods 12, FIG. 2, thus clamping and holding a fixed position on the guide rod. To adjust the position of the spring clips on the guide rod, the loops are compressed. Compression of the loops increases the length of the coil, causing a corresponding increase in the diameter of the coil.

The components of the outer frame, the inner frame, and the coupling means are identified specifically in FIG. 1. Outer frame 12 consists of outer crossbar 18 and outer grip bar 20 transversely mounted on parallel rods 14 and 16. The inner frame is mounted for movement along the parallel rods and includes inner crossbar 26 and inner grip bar 28 which are parallel and adjacent to the outer crossbar and the outer grip bar of the outer frame. When using the apparatus for exercise or therapy, a hand grasping outer grip bar 20 and inner grip bar 28 closes, opposing the resisting force supplied by coupling means 32 to pull the two components together in the grasping stroke. After the outer grip bar and the inner grip bar are compressed together, the hand then opens in a releasing stroke, and the inner frame slides away from outer grip bar 20. During each exercising session, this hand stroke is repeated as many times as are appropriate.

In order to protect the hand and reduce the soreness and blistering which may develop during the exercising session, inner cushion sleeve 30 and outer cushion sleeve 44 are mounted on inner grip bar 28 an outer grip bar 20 respectively. The cushion sleeves are formed of a spongy, porous material which yields elastically when grasped by a hand. Outer cushion sleeve 44 provides padding between the palm of a hand and the outer grip bar, while inner cushion sleeve 30 prevents the finger skin from pinching during the hand stroke. As the hand closes around the outer grip bar and inner grip bar, inner cushion sleeve 30 and outer cushion sleeve 44 elastically yield to the pressure of the hand, reducing discomfort and soreness.

As not to interfere with the stroke of the hand, the potential distance over which the inner frame may be moved along the outer frame is increased by an area of reduced thickness 46 in outer cushion sleeve 44. This area 46 is configured to receive inner grip bar 28. In one embodiment, shown in cross section in FIG. 4, the area of reduced thickness is formed as a substantially planar surface 48. Alternatively, area 46 is formed as a groove 50 in outer cushion sleeve 44, as is shown in FIG. 5. The area of reduced thickness of cushioning sleeve 44 allows the inner grip bar to be moved close to the outer grip bar, increasing the stroke of the hand during the exercise session.

Figure 4:
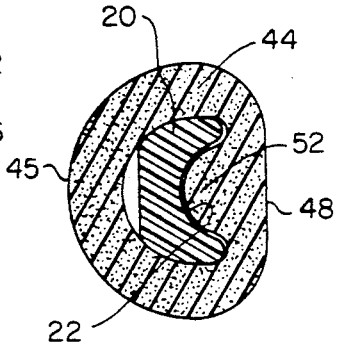
FIG. 4 shows an enlarged cross-sectional view of a cushion sleeve mounted on the outer frame as taken along line 4—4 in FIG. 1.
Figure 5:
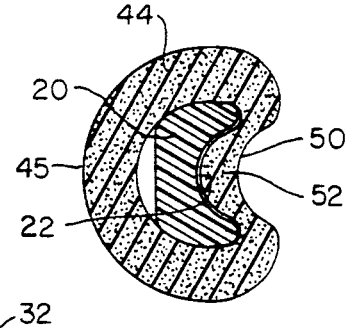
FIG. 5 shows an enlarged cross-sectional view of an alternative embodiment of a cushion sleeve mounted on an outer frame, designed in accordance with the invention.

A portion 45 of outer cushion sleeve 44 opposite area 46 fits into the palm of the hand and is substantially rounded, as shown in FIGS. 4-5. This padding protects the palm of the hand from blistering and soreness which would otherwise be caused by outer grip bar 20. In an alternative embodiment, shown in FIG. 6, portion 45 has more of an oval shape and is configured to conform to the shape of the palm of the hand as it grasps the outer grip bar and the inner grip bar. This alternative embodiment provides even more padding to protect the palm of the hand during the use of the apparatus.

Figure 7:
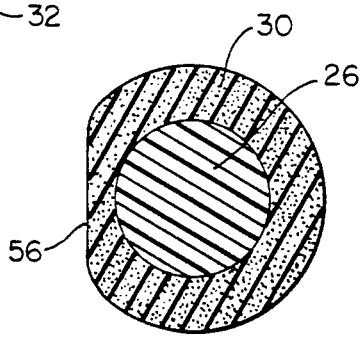
FIG. 7 shows an enlarged cross-sectional view of a cushion sleeve mounted on the inner frame as taken along line 7—7 in FIG. 1.
Figure 8:
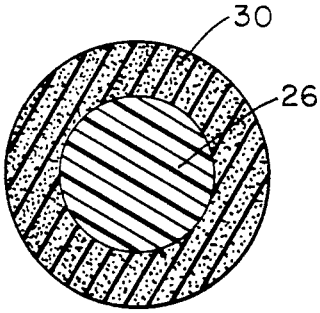
FIG. 8 shows an enlarged cross-sectional view of an alternative embodiment of the cushion sleeve mounted on an inner frame, designed in accordance with this invention.

In another embodiment of the invention, shown in FIG. 7, inner cushion sleeve 30 also has an area of reduced thickness 56 positioned on inner grip bar 28 in a confronting relationship with area 48 on outer grip bar 20. Area 56 further increases the stroke of the handing grasping the outer grip bar and inner grip bar. In an alternative embodiment, shown in FIG. 8; inner cushion sleeve 30 has a substantially consistent thickness. This alternative embodiment is most desirable for use in conjunction with the embodiment of outer cushion sleeve 44 in which area 46 formed as groove 50. As the inner grip bar is moved toward the outer grip bar, the rounded surface of inner cushion sleeve 30 will fit into the groove in outer cushion sleeve 44.

Figure 6:
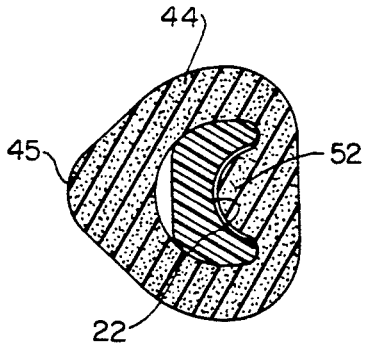
FIG. 6 shows an enlarged cross-sectional view of an additional alternative embodiment of a cushion sleeve mounted on an outer frame, designed in accordance with the invention.

To prevent any rotation of outer cushion sleeve 44, a ridge 52 protruding from the inner surface of cushioning sleeve 44 fits into a channel 22 in outer grip bar 20, as shown in FIGS. 4-6. By reducing this rotation, the stroke of the hand grasping and releasing the outer grip bar and the inner grip bar is controlled, ensuring that the proper muscles in the hand are forearm are being exercised.

The cushion sleeves protect the portions of the hand which contact the outer grip bar and the inner grip bar when using the apparatus. Inner cushion sleeve 30 and outer cushion sleeve 44 have an additional advantage in that they do not interfere with the motion of the hand during the exercise session. Areas 46 and 54 ensure that the apparatus permits a full hand stroke. Ridge 52 and channel 22 act in conjunction to prevent any rotation of outer cushion sleeve 44 about outer grip bar 20 which would distort the hand stroke.

In order to provide the resisting force necessary to strengthen the muscles, coupling means 32 connect inner frame 24 to outer frame 12. In the preferred embodiment, shown specifically in FIG. 1, a plurality of fastening means 34 are mounted to outer crossbar 18. Endless elastic rubber bands 36 and 37 wrap around outer crossbar 18 and inner crossbar 26 and are anchored by fastening means 34. As the inner frame is moved along the outer frame in the direction of outer grip bar 20, the rubber bands are pulling the inner frame towards outer crossbar 18. Thus, the hand must apply a force which overcomes the pull of the rubber bands to close and compress the outer grip bar and the inner grip bar together.

In FIG. 1, coupling means 32 includes two rubber bands 36 and 37, while in FIG. 3 only one rubber band 36 is in place. Incorporating a different number of rubber bands will vary the resisting force supplied by the coupling means. In the present invention, a rubber band may be installed on any or all of fastening means 34. As the muscles strength in the hand and forearm increases with use of the apparatus, additional rubber bands may be added to the coupling means. This ensures that the apparatus continues to work the muscles in the hand and forearm.

In the preferred embodiment, the fastening means are mounted to outer crossbar 18 and face inner crossbar 26. Fastening means 34 may be affixed at any location along the circumference of outer crossbar 18. Additionally, it is within the scope of this invention to mount the fastening means to inner crossbar 26 instead of outer crossbar 18 for anchoring the rubber bands wrapped around the outer crossbar and the inner crossbar.

Figure 9:
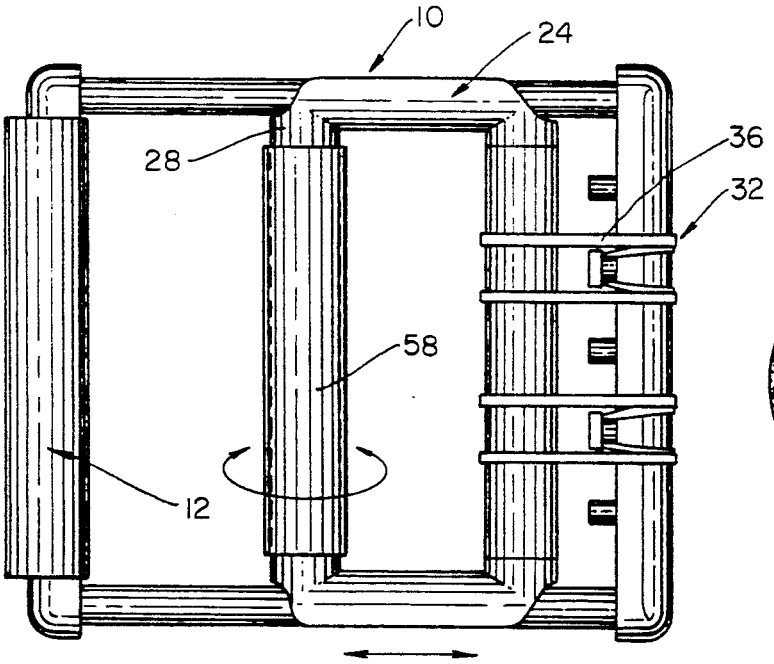
FIG. 9 shows a frontal view of an alternative embodiment of a hand exercising apparatus designed in accordance with this invention.

An alternative embodiment of hand exercising apparatus 10 is shown in FIG. 9. Inner frame 24 includes rotatable gripping means in the form of a hollow cylinder 58 mounted on inner grip bar 28. During the grasping stroke, the hollow cylinder rotates about inner grip bar 28 in response to the motion of the fingers as the hand closes about the outer grip bar and the inner grip bar. The rotatable gripping means provides for a more natural hand stroke when the apparatus is used by an individual with larger hands. Instead of awkwardly sliding about the inner grip bar, the fingers bend naturally, moving hollow cylinder 58, to pull the inner frame toward the outer grip bar.

To provide extra comfort for a hand using this alternative embodiment of apparatus 10, inner cushion sleeve 30 (not shown) may be mounted on the hollow cylinder on inner grip bar 28. As previously discussed, inner cushion sleeve 30 pads the inner grip bar to protect the finger skin from pinching and the development of blisters. Inner cushion sleeve 30, mounted in place, rotates with hollow cylinder 58 as the hand closes around the outer grip bar and the inner grip bar. Thus, adding inner cushion sleeve 30 to the apparatus shown in FIG. 9 guards against soreness and discomfort while preserving the natural movement of the hand.

In the preferred embodiments of the invention, the inner and outer frames are formed of plastic, and the cushion sleeves are made from an Acrylonitrile/PVC blend. However, other appropriate materials may be used. The rubber bands used by the coupling means may be replaced by another material which provides an appropriate resisting force to pull the inner frame towards the outer grip bar.

What is claimed is:

1. A hand exercising apparatus comprising:

(a) an outer frame having a pair of parallel rods with an outer crossbar and an outer grip bar transversely mounted therebetween, said outer grip bar having a channel formed therein;

(b) an inner frame slidably mounted in said outer frame for movement along said parallel rods between said outer crossbar and said outer grip bar, said inner frame having an inner crossbar and an inner grip bar parallel and adjacent to said outer crossbar and said outer grip bar respectively, said inner grip bar having an inner cushion sleeve mounted thereon;

(c) means for coupling said inner crossbar to said outer crossbar and providing a resisting force when said inner frame is moved along said outer frame;

(d) an outer cushion sleeve configured for facilitating the natural movement of a hand grasping said outer grip bar mounted on said outer grip bar and having an area of reduced thickness formed for receiving said inner grip bar as said inner frame is moved along said outer frame and having a ridge protruding from the inner surface thereof which substantially conforms to said channel of said outer grip bar, whereby any rotation of said outer sleeve about said outer grip bar in response to the grasping motion of a hand is prevented; and (e) means for altering the distance along said outer frame over which said inner frame may be moved, said altering means including a spring clip adjustably mounted on each of said parallel rods between said inner frame and one of said outer crossbar and said outer grip bar, said spring clips capable of being positioned at different locations along said parallel rods and adjustably mounted thereto, whereby said spring clips effectively shorten the distance over which said inner frame may be moved along said outer frame.

2. The apparatus of claim 1 wherein said inner and outer sleeves are formed of a resilient material which yields elastically to conform to a hand applying a compressive force thereto.

3. The apparatus of claim 1 wherein said inner and outer sleeves are formed of a spongy porous material.

4. The apparatus of claim 1 wherein the portion of said second sleeve opposing said area of reduced thickness is configured to conform to and support a hand grasping said second crossbar.

5. The apparatus of claim 1 wherein said area of reduced thickness is formed having a substantially planar surface for receiving said inner grip bar.

6. The apparatus of claim 1 wherein said area of reduces thickness is a groove formed for receiving said second crossbar.

7. The apparatus of claim 1 wherein said first sleeve has an area of reduced thickness positioned in a confronting relationship with said area of thickness of said second sleeve.

8. The apparatus of claim 7 wherein said area of reduced thickness of said first sleeve is formed having a substantially planar surface.

9. The apparatus of claim 1 wherein said inner grip bar has rotatable gripping means mounted thereon, and wherein said inner sleeve is mounted on said gripping means mounted on said inner grip bar.

10. The apparatus of claim 9 wherein said gripping means includes a hollow cylinder mounted around said inner grip bar.

11. The apparatus of claim 1 wherein said coupling means includes a plurality of fastening means mounted on one of said outer crossbar and said inner crossbar, and at least one endless rubber band affixed to said fastening means and wrapped around the other of said outer crossbar and said inner crossbar.

12. A hand exercising apparatus comprising:

(a) an outer frame having an outer grip bar and a movable inner frame having an inner grip bar, said outer grip bar having a channel formed therein;

(b) means for resisting the movement of said inner frame to thereby require the application of a force to said inner grip bar to move said inner frame towards said outer grip bar; and (c) a cushion sleeve configured for facilitating the natural movement of a hand grasping said outer grip bar and said inner grip bar mounted on said outer grip bar an having an area of thickness formed for receiving said inner grip bar when said inner frame is moved towards said outer grip bar, said sleeve having a ridge protruding from the inner surface of said sleeve which conforms to said channel of said outer grip bar, whereby any rotation of said sleeve about said outer grip bar in response to the grasping motion of a hand is prevented.

13. The apparatus of claim 12 wherein the portion of said sleeve opposite said area of reduced thickness is configured to conform to the palm of a hand which is grasping said bracing bar.

14. The apparatus of claim 12 wherein said sleeve is formed of a resilient material which elastically yields to conform to the palm of a hand which is applying a compressive force thereto.

15. The apparatus of claim 12 wherein said area of reduced thickness is formed having a substantially planar surface for receiving said inner grip bar.

16. The apparatus of claim 12 wherein said area of reduced thickness is a concave surface formed for receiving said gripping bar.

17. The apparatus of claim 12 and including an inner cushion sleeve mounted on said inner grip bar.

18. The apparatus of claim 17 wherein said inner sleeve has an area of reduced thickness positioned in a confronting relationship with said area of reduced thickness of said sleeve mounted on said outer grip bar.

19. The apparatus of claim 17 wherein said inner sleeve is formed of a resilient material which elastically yields to conform to a hand applying a compressive force thereto.

20. The apparatus of claim 12 and including means for altering the distance over which said inner grip bar may be moved.

21. A hand exercising apparatus comprising:

(a) an outer frame having a pair of parallel rods with an outer crossbar and an outer grip bar transversely mounted therebetween and said outer grip bar having a channel formed therein;

(b) an inner frame slidably mounted in said outer frame for movement along said parallel rods between said outer crossbar and said outer grip bar, said inner frame having an inner crossbar and an inner grip bar parallel and adjacent to said outer crossbar and said outer grip bar respectively, said inner grip bar having rotatable gripping means mounted thereon;

(c) means for coupling said inner crossbar to said outer crossbar and providing a resisting force when said inner frame is moved along said outer frame; and (d) a cushion sleeve configured for facilitating the natural movement of a hand grasping said outer grip bar mounted on said outer grip bar and having an area of reduced thickness formed for receiving said inner grip bar as said inner fame is moved along said outer frame, said sleeve having a ridge protruding from the inner surface of said sleeve which conforms to said channel of said outer grip bar, whereby any rotation of said sleeve about said outer grip bar in response to the grasping motion of a hand is prevented.

22. The apparatus of claim 21 wherein said sleeve is formed of a resilient material which yields elastically to conform to a hand applying a compressive force thereto.

23. The apparatus of claim 21 wherein said sleeve is formed of a spongy, porous material.

24. The apparatus of claim 21 wherein the portion of said sleeve opposing said area of reduced thickness is configured to conform to and support a hand grasping said inner grip bar.

25. The apparatus of claim 21 wherein said area of reduced thickness is formed having a substantially planar surface for receiving said inner grip bar.

26. The apparatus of claim 21 wherein said area of reduced thickness is a groove formed for receiving said inner grip bar.

27. The apparatus of claim wherein said outer grip bar has a channel formed therein, and said sleeve has a ridge protruding from the inner surface thereof which conforms to said channel, whereby any rotation of said sleeve about said outer grip bar is prevented.

28. The apparatus of claim 21 wherein said gripping means includes a hollow cylinder mounted around said inner grip bar.

29. The apparatus of claim 28 and including an inner cushion sleeve mounted on said hollow cylinder.

30. The apparatus of claim wherein said inner sleeve has an area of reduced thickness positioned in a confronting relationship with said area of reduced thickness of said sleeve mounted on said outer grip bar.

31. The apparatus of claim wherein said coupling means includes a plurality of fastening means mounted on one of said outer crossbar and said inner crossbar, and at least one endless rubber band affixed to said fastening means and wrapped around the other of said outer crossbar and said inner crossbar.

32. The apparatus of claim 21 and including means for altering the distance along said outer frame over which said inner frame may travel.

33. The apparatus of claim 32 wherein said altering means includes a spring clip adjustably mounted on each of said parallel rods between said inner frame and one of said outer crossbar and said outer grip bar, said spring clips capable of being positioned at different locations along said parallel rods and adjustably mounted thereto, whereby said spring clips effectively shorten the distance over which said inner frame may be moved along said outer frame.

* * * * *